United States Patent [19]

Londry et al.

[11] Patent Number: 4,626,476

[45] Date of Patent: Dec. 2, 1986

[54] WEAR AND CORROSION RESISTANT COATINGS APPLIED AT HIGH DEPOSITION RATES

[75] Inventors: Calvin H. Londry; Thomas A. Adler, both of Indianapolis, Ind.

[73] Assignee: Union Carbide Corporation, Danbury, Conn.

[21] Appl. No.: 831,327

[22] Filed: Feb. 20, 1986

Related U.S. Application Data

[63] Continuation-in-part of Ser. No. 546,541, Oct. 28, 1983, abandoned.

[51] Int. Cl.[4] ..... B32B 15/04; B05D 1/00; B05D 1/02; B05D 1/10

[52] U.S. Cl. ..... 428/457; 106/1.05; 239/79; 420/431; 427/34; 427/37; 427/427; 428/698; 428/699

[58] Field of Search ..... 428/457, 404, 472, 698, 428/699; 427/34, 37, 427; 106/1.05; 420/431; 239/79

[56] References Cited

U.S. PATENT DOCUMENTS

| | | | |
|---|---|---|---|
| 2,714,563 | 8/1955 | Poorman et al. | 428/472 X |
| 2,950,867 | 8/1960 | Hawley et al. | 427/427 X |
| 3,016,447 | 1/1962 | Gage et al. | 427/37 X |
| 3,421,890 | 1/1969 | Bäumel | 106/1.05 X |
| 3,914,507 | 10/1975 | Fustukian | 428/404 |
| 4,519,840 | 5/1985 | Jackson et al. | 106/1.05 |

*Primary Examiner*—Thomas J. Herbert
*Attorney, Agent, or Firm*—Norman L. Balmer

[57] ABSTRACT

A coating composition applied to a substrate by a thermal spray process which consists essentially of from about 4.0 to about 10.5 weight percent cobalt, from about 5.0 to about 11.5 weight percent chromium, from about 3.0 to about 5.0 weight percent carbon and the balance tungsten.

35 Claims, No Drawings

WEAR AND CORROSION RESISTANT COATINGS APPLIED AT HIGH DEPOSITION RATES

This application is a continuation-in-part of application Ser. No. 546,541, filed Oct. 28, 1983 now abandoned.

RELATED APPLICATIONS

Copending application Ser. No. 546,542, now abandoned of J. E. Jackson et al. entitled "Wear and Corrosion Resistant Coatings and Methods for Producing the Same", and copending application Ser. No. 546,480 of J. E. Jackson et al. entitled "High Strength, Wear and Corrosion Resistant Coatings and Methods for Producing the Same", now U.S. Pat. No. 4,519,840, issued May 28, 1985, both filed on Oct. 28, 1983, disclose and claim subject matter which is related to the present application.

TECHNICAL FIELD

The present invention relates to wear and corrosion resistant coatings and to a method for producing such coatings. More particularly, the invention relates to a new family of W—Co—Cr—C coatings having improved strength and wear resistance.

BACKGROUND ART

Coatings of W—Co—Cr—C are used in applications where both superior wear and corrosion resistance are required. A typical composition for these coatings comprises about 8 to 10 weight percent cobalt, about 3 to 4 weight percent chromium, about 4.5 to 5.5 weight percent carbon and the balance tungsten. These coatings can be successfully applied to various substrates, e.g., iron base alloy substrates, using known thermal spray techniques. Such techniques include, for example, detonation gun (D-Gun) deposition as disclosed in U.S. Pat. Nos. 2,714,563 and 2.950,867, plasma arc spray as disclosed in U.S. Pat. Nos. 2,858,411 and 3,016,447, and other so-called "high velocity" plasma or "hypersonic" combustion spray processes.

Although coatings of W—Co—Cr—C have been employed successfully in many industrial applications over the past decade or more, there is an ever increasing demand for even better coatings having superior strength and wear resistance.

It is also desirable to deposit these coatings at faster deposition rates than heretofore possible and thereby coat the substrates more economically. A problem with fast deposition rates, however, has been that high residual stresses tend to build up inside the coating. Unless the coating has sufficiently high strength to resist these stresses, the coating may crack and even spall.

In the copending application Ser. No. 546,480 of J. E. Jackson et al., filed on Oct. 28, 1983, and assigned to the common assignee hereof, there is disclosed a new family of W—Co—Cr—C coatings containing a high content of cobalt and having an improved strength. These coatings are ideally suited for use on gate valves, for example, in the petrochemical industry for handling highly corrosive fluids under high hydraulic pressures. Although these coatings are tough and strong enough to resist the high residual stresses that develop as a result of fast deposition rates, the wear resistance of the coatings is no better than that of conventional coatings.

As is generally known, coatings of W—Co—Cr—C derive their wear resistance from the presence of complex carbides of W, Co, and Cr. Corrosion resistance is derived, on the other hand, from the presence of chromium. The chromium content is actually a compromise between that which is ordinarily required for corrosion resistance and that which interferes with or diminishes the wear and mechanical properties of the coating.

SUMMARY OF THE INVENTION

It has now been surprisingly discovered in accordance with the present invention that, contrary to expectations, a higher chromium content can be employed if properly balanced with that of both carbon and cobalt to achieve improved coatings with low wear rates and capable of being deposited at much higher deposition rates without cracking or spalling.

A coating composition (i.e., when applied) in accordance with the present invention consists essentially of from about 4.0 to about 10.5, often about 8.0 to about 10.5, weight percent cobalt; from about 5.0 to about 11.5, often about 5.0 to 8.0, weight percent chromium; from about 3.0 to about 5.0, often about 3.0 to 4.0, weight percent carbon and the balance tungsten.

DESCRIPTION OF THE PREFERRED EMBODIMENTS

The coatings of the present invention can be applied to a substrate using any conventional thermal spray technique. The preferred method of applying the coatings is by detonation gun (D-Gun) deposition. A typical D-Gun consists essentially of a water-cooled barrel which is several feet long with an inside diameter of about 1 inch. In operation, a mixture of oxygen and a fuel gas, e.g., acetylene, in a specified ratio (usually about 1:1) is fed into the barrel along with a charge of powder to be coated. The gas is then ignited and the detonation wave accelerates the powder to about 2400 ft./sec. (730 m/sec.) while heating the powder close to or above its melting point. After the powder exits the barrel, a pulse of nitrogen purges the barrel and readies the system for the next detonation. The cycle is then repeated many times a second.

The D-Gun deposits a circle of coating on the substrate with each detonation. The circles of coating are about 1 inch (25 mm) in diameter and a few ten thousandths of an inch (microns) thick. Each circle of coating is composed of many overlapping microscopic splats corresponding to the individual powder particles. The overlapping splats interlock and mechanically bond to each other and the substrate without substantially alloying at the interface thereof. The placement of the circles in the coating deposition are closely controlled to build-up a smooth coating of uniform thickness and to minimize substrate heating and residual stresses in the applied coating.

The powder used in producing the coating of the present invention is chosen to achieve the particular coating composition desired using a given set of deposition parameters. Preferably, the oxygen-fuel gas mixture ratio employed in the D-Gun process is maintained at about 1.0. It is also possible to use other operating conditions with a D-Gun and still obtain the desired coating composition if the powder composition is adjusted accordingly. Moreover, other powder compositions may be used with other thermal spray coating devices to compensate for changes in composition during deposition and obtain the desired coating composition of the present invention.

The powders used in the D-Gun for applying a coating according to the present invention are preferably cast and crushed powders. However, other forms of powder such as sintered powders can also be used. Generally, the size of the powders should be about −325 mesh. Powders produced by other methods of manufacture and with other size distributions may be used according to the present invention with other thermal spray deposition techniques if they are more suited to a particular spray device and/or size.

A typical powder composition for depositing a coating according to the present invention consists essentially of from about 8.0 to 12.0, often about 10.0 to 12.0, and in some instances about 8.0 to about 11.0, weight percent cobalt; from about 6.0 to 11.0, preferably about 6.0 to 6.5, and sometimes about 8.0 to about 11.0, weight percent chromium, from about 2.5 to 5.5, often about 2.5 to 3.5, and in some instances about 4.0 to about 5.5, weight percent carbon and the balance tungsten. Some of the carbon may be uncombined carbon, e.g., up to about 1.0 weight percent, which may be lost in the deposition process. The feed rate of both oxygen and fuel gas (e.g., acetylene) should be adjusted with this powder to provide an oxy-fuel gas ratio of about 1.0. This is the same ratio that has been used to deposit conventional coatings of the prior art.

Alternatively, the coating of the present invention can be applied to a substrate by plasma arc spray or other thermal spray techniques. In the plasma arc spray process, an electric arc is established between a non-consumable electrode and a second non-consumable electrode spaced therefrom. A gas is passed in contact with the non-consumable electrode such that it contains the arc. The arc-containing gas is constricted by a nozzle and results in a high thermal content effluent. Powdered coating material is injected into the high thermal content effluent nozzle and is deposited onto the surface to be coated. This process, which is described in U.S. Pat. No. 2,858,411, supra, produces a deposited coating which is sound, dense and adherent to the substrate. The applied coating also consists of irregularly shaped microscopic splats or leaves which are interlocked and mechanically bonded to one another and also to the substrate.

In those cases where the plasma arc spray process is used to apply the coatings in the present invention, powders fed to the arc torch may have essentially the same composition as the applied coating itself. With some plasma arc or other thermal spray equipment, however, some change in composition is to be expected, and, in such cases, the powder composition may be adjusted accordingly to achieve the coating composition of the present invention.

The coatings of the present invention may be applied to almost any type of substrate, e.g., metallic substrates such as iron or steel or non-metallic substrates such as carbon, graphite or polymers, for instance. Some examples of substrate material used in various environments and admirably suited as substrates for the coatings of the present invention include, for example, steel, stainless steel, iron base alloys, nickel, nickel base alloys, cobalt, cobalt base alloys, chromium, chromium base alloys, titanium, titanium base alloys, aluminum, aluminum base alloys, copper, copper base alloys, refractory metals and refractory-metal base alloys.

The composition of the coatings of the present invention will vary within the ranges indicated above, depending on certain conditions such as the deposition rate. For example, in those cases where the coating is applied at high deposition rates, e.g., about 100 grams per minute, it is preferred to employ a coating having a composition consisting essentially of from about 5.5 to about 7.5 weight percent cobalt, from about 5.5 to about 7.5 weight percent chromium, from about 3.0 to about 5.0 weight percent carbon and the balance tungsten. However, when the coatings are applied at more moderate deposition rates, say about 75 grams per minute, coatings containing a somewhat high cobalt content are desired. A preferred coating composition for such applications consists essentially of from about 9.7 to about 10.1 weight percent cobalt, from about 5.0 to 5.3 weight percent chromium, from about 3.4 to 3.7 weight percent carbon, and the balance tungsten. In some instances the ratio of cobalt to chromium is about 1:1; however, often the weight ratio of cobalt to chromium is greater than 1.8:1.

The microstructure of the coatings of the present invention are very complex and not completely understood. However, the major and some of the minor phases of both the powder and coating composition have been identified using essentially three techniques: (1) X-ray diffraction, (2) metallography, and (3) scanning electron microscopy (SEM). X-ray diffraction identifies the phases and gives an estimate of their volumetric amounts. However, some of the phases present in smaller amounts are not observed with X-ray diffraction. The following phases were identified with X-ray diffraction:

Powder
Major: $W_2C$
Minor: Hexagonal WC, $CoW_3C$
Coating
Major: $W_2C$
Minor: Cubic WC Coatings of the present invention exhibit both improved strength and wear resistance as compared to conventional coatings of the prior art. Because of their improved strength, they are ideally suited for use on gate valves employed in well service equipment for handling highly corrosive fluids (e.g., solutions containing chlorides, carbon monoxide, carbon dioxide, hydrogen sulfide, vanadium salts, etc.) under moderately high hydraulic pressures, typically about 10,000 psi, and temperatures above 200° F. In the past, conventional coatings failed under these conditions mostly due to their relatively low tensile strength.

The mechanism of these failures is believed to be as follows: At high pressures and at sufficiently high temperatures, the pressurized fluid slowly diffuses through the thickness of the coating and accumulates within the porosity of the coating. During this phase, the coating is in compression and resists quite well the ambient pressure. After a certain time, the pressure within the porosity reaches a value equal to the ambient pressure, and the inward diffusion of fluid stops. As long as the pressure is maintained, the coating is not subjected to any unusual stresses.

Once the ambient pressure is released, however, the pressure within the porosity is no longer balanced by the ambient pressure. Before the pressurized fluid within the porosity has had time to diffuse out of the coating, the coating is stressed or loaded from within itself. If the internal specific load in the coating exceeds the fracture stress of the coating, the coating will fail outwardly from within the coating.

To satisfy the stringent requirements for gate valves subjected to high pressures and temperatures, it is imperative that stronger coatings be provided while still maintaining all of the normal requirements for gate valve coatings, such as wear and corrosion resistance.

Typically, coatings containing tungsten carbide, cobalt or nickel, and chromium have shown a low resistance to the type of failures described above and a low strength when loaded hydraulically in an outward direction from the interface. However, these coatings have shown a good resistance to wear and corrosion. On the other hand, coatings containing tungsten carbide and cobalt but devoid of any chromium have shown a good resistance to failure and a high strength when subjected to high internal pressures. Because of their lack of chromium, however, these coatings provide little or no resistance to corrosion. The addition of chromium to the coatings may increase its resistance to corrosion but at the cost of lowering the strength of the coating to the point where the coating will fail when subjected to high internal pressures.

Coatings of the present invention represent a significant and unexpected improvement over the prior art. The coatings incorporate not only enough chromium to provide corrosion resistance but also enough cobalt, tungsten and carbon in appropriate relative proportions to provide a 50 percent improvement in toughness and strength over that of prior coatings while at the same time significantly increasing wear resistance. Although the exact reasons for improved strength and wear resistance are not clearly understood, it is believed that they result form a change in chemistry and accompanying phase changes in the coating.

In addition to improved strength and wear resistance, the present invention offers the advantage in that the coatings can be applied to a substrate at a faster deposition rate than that heretofore possible without cracking or spalling. This is, of course, made possible by the fact that the coating of the present invention possesses sufficient strength to withstand the build-up of high residual stresses that result when the coating is deposited at high rates. The use of high deposition rates significantly reduces the cost of producing a coating since less equipment and operator time is required.

Another advantage of the present invention is that the coating exhibits a smooth "as-deposited" surface which requires less grinding to finish the coating as compared to the coatings of the prior art. Stated in other words, coatings of the present invention require less coating material to be deposited onto the substrate in order to achieve the same finish coating surface and thickness as that of prior coatings without, however, lowering the coatings requirements of resistance to abrasion and corrosion. Moreover, since less coating material needs to be deposited, the coating process is far more efficient and less costly than that of the prior art.

The following examples will serve to further illustrate the practice of the present invention.

EXAMPLE I (Comparative)

Specimens of AISI 1018 steel were cleaned and prepared for coating as follows: The surface on one side of each specimen was ground smooth and parallel to the opposite side. The surface was then grit blasted with 60 mesh $Al_2O_3$ to a surface roughness of about 120 micro-inch RMS. Three specimens were set aside and prepared for hydraulic pressure test as follows: On the side to be coated, eight small holes, 0.020 inch (0.51 mm) in diameter, were drilled in the specimen substrate perpendicular to its surface to a depth of a few tenths of an inch (a few mm). The holes were then enlarged so as to accommodate leak tight couplings. Piano wires, 0.020 inch (0.51 mm) in diameter, were then inserted through the couplings into the small holes and firmly secured so their ends were even and provided a smooth continuation with the surface to be coated. All the specimens were then coated according to the prior art using a detonation gun (D-Gun) and a sintered powder of the following composition: 10 weight percent Co, 4 weight percent Cr, 5.2 weight percent C, and the balance W. The size of the powders was about −325 mesh. Acetylene was used as the fuel-gas. The oxy-fuel gas ratio was 0.98. The feed rate was 75 grams per min.

A chemical analysis of the coating showed the following composition: 8 weight percent Co, 3.2 weight percent Cr, 4.7 weight percent C and the balance W. The chemical analysis was carried out principally by two methods. Carbon was analyzed by a combustion analysis technique using a Leco Carbon Analyzer and volumetric determination of gaseous output. Cobalt and chromium were analyzed by first fusing the sample in $Na_2O_2$ and separating the cobalt and chromium, then determining the amount of each potentiometrically.

The mechanical strength of the coating was determined by an hydraulic pressure test as follows: After coating the specimen prepared for this test in the manner described above, the piano wires were carefully removed providing cavities directly under the coating. By means of the couplings, the cavities were then connected to an hydraulic pressure system and the cavities filled with an hydraulic fluid. The fluid was then pressurized, loading the coating from the interface outward until failure of the coating occurred. Eight measurements were made on each coating and the average value defined as the failure pressure. The failure pressure was taken to be a measure of the coating's mechanical strength for the specific coating thickness. The failure pressures can then be used to rank different coatings of basically the same thickness. The failure pressures for the three coatings were 5,400 psi at a thickness of 0.0044 inch, 10,300 psi at a thickness of 0.0083 inch and 13,200 psi at 0.0105 inch. Linear regression predicts a failure pressure of 8,300 psi at 0.0067 inch thick coating.

Abrasive wear properties of the applied coating were also determined using the standard dry sand/rubber wheel abrasion test described in ASTM Standard G65-80, Procedure A. In this test, the coated specimens were loaded by means of a lever arm against a rotating wheel with a chlorobutyl rubber rim around the wheel. An abrasive (i.e., 50–70 mesh Ottawa Silica Sand) was introduced between the coatings and the rubber wheel. The wheel was rotated in the direction of the abrasive flow. The test specimen was weighed before and after the test and its weight loss was recorded. Because of the wide differences in the densities of different materials tested, the mass loss is normally converted to volume loss to evaluate the relative ranking of materials. The average volume loss for the coated specimens tested (conventional W—Co—Cr—C coating) was 1.7 $mm^3$ per 1,000 revolutions.

The hardness of the coatings was also measured by standard methods. The average hardness was found to be 1100 $DPH_{300}$.

EXAMPLE II (Comparative)

Specimens of AISI 1018 steel, including one specimen for the hydraulic pressure test, were prepared in the same manner as described in Example I. The specimen surfaces were then coated using a D-Gun and a cast and crushed powder of the following composition: 14.1 weight percent Co, 4.8 weight percent Cr, 4.2 weight percent C and the balance W. The powder size was −325 mesh. Acetylene was also used as the fuel gas. The oxy-fuel gas ratio in the D-Gun was 0.98. The feed rate was 100 grams per minute.

A chemical analysis of the coating was performed using the same methods described in Example I. The analysis showed the following composition: 16.5 weight percent Co, 4.9 weight percent Cr, 3.7 weight percent C and the balance W.

The mechanical strength of the coating was determined using the same hydraulic pressure test. The failure pressure for this particular coating was 27,900 psi at a thickness of 0.0068 inch.

Abrasive wear tests were also carried out using the ASTM Standard G65-80, Procedure A. The average volume loss for the coated specimens was 1.8 $mm^3$ per 1,000 revolutions.

The hardness of the coatings was also measured and found to be 1000 $DPH_{300}$.

This example illustrates a coating prepared according to the copending application Ser. No. 546,480, supra, containing a high content of cobalt, i.e., 11.0 to 18.0 weight percent, and having an improved toughness and strength. The wear resistance of this particular coating is approximately equivalent to the coatings of the prior art as represented by Example I.

EXAMPLE III (Comparative)

Specimens of AISI 1018 steel, including one specimen for the hydraulic pressure test, were prepared in the same manner as described in Example I. The specimen surfaces were then coated using a D-Gun and a cast and crushed powder of the following composition: 12.0 weight percent Co, 2.1 weight percent Cr, 4.9 weight percent C and the balance W. The powder size was −325 mesh. Acetylene was also used as the fuel gas. The oxy-fuel gas ratio in the D-Gun was 0.98. The feed rate was 150 grams per minute.

A chemical analysis of the coating was performed using the same methods described in Example I. The analysis showed the following composition: 17.9 weight percent Co, 2.8 weight percent Cr, 4.1 weight percent C and the balance W.

The same hydraulic pressure test was employed to determine the mechanical strength of the coating. The failure pressure for this particular coating was 26,500 psi at a thickness of 0.0067 inch.

Abrasive wear tests were also carried out using the ASTM Standard G65-80, Procedure A. The average volume loss for the coated specimens was 3.6 $mm^3$ per 1,000 revolutions.

The hardness of the coatings were also measured and found to be 1000 $DPH_{300}$.

This example illustrates a coating prepared according to the copending application Ser. No. 546,480, supra, containing a high strength, but in which the wear resistance was less than that of the prior art coating for Example I

EXAMPLE IV

Specimens of AISI 1018 steel, including one specimen for the hydraulic pressure test, were prepared in the same manner as described in Example I. The specimen surfaces were then coated using a D-Gun and a cast and crushed powder of the following composition: 9.6 weight percent Co, 9.5 weight percent Cr, 4.9 weight percent C and the balance W. The powder size was −325 mesh. Acetylene was also used as the fuel gas. The oxy-fuel gas ratio in the D-Gun was 0.98. The feed rate was 150 grams per minute.

A chemical analysis of the coating was performed using the same methods described in Example I. The analysis showed the following composition: 6.9 weight percent Co, 6.9 weight percent Cr, 4.2 weight percent C and the balance W.

The same hydraulic pressure test was employed to determine the mechanical strength of the coating. The failure pressure for this particular coating was 13,000 psi at a thickness of 0.0068 inch. This represents a 50 percent improvement in strength as compared to the coated specimen tested in Example I.

Abrasive wear tests were also carried out using the ASTM Standard G65-80, Procedure A. The average volume loss for the coated specimens was 1.0 $mm^3$ per 1,000 revolutions.

The hardness of the coatings was also measured and found to be 1209 $DPH_{300}$.

This example illustrates a coating prepared according to the present invention having a moderately high strength and a superior wear resistance. The coating was applied at a fast deposition rate, i.e., 150 grams per minute, but no cracks or spalling occurred.

EXAMPLE V (Comparative)

Specimens of AISI 1018 steel, including one specimen for the hydraulic pressure test, were prepared in the same manner as described in Example I. The specimen surfaces were then coated using a plasma spray torch and a conventional sintered powder of the following composition: 10 weight percent Co, 4 weight percent Cr, 5.2 weight percent C and the balance W. The powder size was −325 mesh.

A chemical analysis of the coating was performed using the same methods described in Example I. The analysis showed the following composition: 9.2 weight percent Co, 3.5 weight percent Cr, 5.0 weight percent C and the balance W.

The same hydraulic pressure test was employed to determine the mechanical strength of the coating. The failure pressure for this particular cating was 9,600 psi at a thickness of 0.0069 inch. Seven measurements were made on this coating instead of eight.

Abrasive wear tests were also carried out using the ASTM Standard G65-80, Procedure A. The average volume loss for the coated specimens was 9.3 $mm^3$ per 1,000 revolutions. The wear properties of this coating were poor even when compared against the wear properties of the conventional D-Gun coatings of Example I. This is to be expected in the case of plasma spray coatings which do not wear as well as D-Gun coatings.

The hardness of the coatings was also measured and found to be 687 $DPH_{300}$.

EXAMPLE VI

Specimens of AISI 1018 steel, including one specimen for the hydraulic pressure test, were prepared in the same manner as described in Example I. The specimen surfaces were then coated using a plasma spray torch and a cast and crushed powder of the following composition: 9.6 weight percent Co, 9.5 weight percent Cr, 4.9 weight percent C and the balance W. This was the same powder composition used in preparing the coatings of Example IV. The powder size was −325 mesh.

A chemical analysis of the coating was performed using the same methods described in Example I. The analysis showed the following composition: 8.7 weight percent Co, 8.1 weight percent Cr, 3.8 weight percent C and the balance W.

The same hydraulic pressure test was employed to determine the mechanical strength of the coating. The failure pressure for this particular cating was 9,300 psi at a thickness of 0.0064 inch.

Abrasive wear tests were also carried out using the ASTM Standard G65-80, Procedure A. The average volume loss for the coated specimens was 6.7 $mm^3$ per 1,000 revolutions. The wear rate for this coating was abut one-third less than that for the plasma spray coating of the previous example using a conventional sintered powder.

The hardness of the coatings was also measured and found to be 775 $DPH_{300}$.

EXAMPLE VII

Specimens of AISI 1018 steel, including one specimen for the hydraulic pressure test, were prepared in the same manner as described in Example I. The specimen surfaces were then coated using a D-Gun and a sintered powder of the following composition: 11.0 weight percent Co, 6.2 weight percent Cr, 3.0 weight percent C and the balance W. The powder size was −325 mesh. Acetylene was used as the fuel gas. The oxy-fuel gas ratio in the D-Gun was 0.98. The feedrate was 75 grams per minute.

A chemical analysis of the coating was performed using the same methods as described in Example I. The analysis showed the following composition: 9.9 weight percent Co, 5.2 weight percent Cr, 3.5 weight percent C and the balance W.

The same hydraulic pressure test was employed to determine the mechanical strength of the coating. The failure pressure for this particular coating was 13,300 psi at a thickness of 0.0065 inch. This represents a 50 percent improvement in strength as compared to the coated specimen tested in Example I.

Abrasive wear tests were also carried out using the ASTM Standard G65-80, Procedure A. The average volume loss for the specimens was 1.1 $mm^3$ per 1000 revolutions.

The hardness of the coatings was also measured and found to be 1045 $DPH_{300}$.

This example illustrates a coating prepared according to the present invention, but starting with a powder with a composition significantly different from the powder used in Example IV, and having a moderately high strength and a superior wear resistance. The coating was applied at a moderate deposition rate, i.e., 75 grams per minute, and no cracks or spalling occurred.

It will be seen from the foregoing that the present invention provides a new family of W—Co—Cr—C coatings having improved strength and superior wear resistance. The D-Gun coatings of this invention are capable of withstanding hydraulic pressures in excess of about 13,000 pounds per square inch at a coating thickness of about 0.006 inch and exhibit a wear rate of only about 1.0 $mm^3$ per 1000 revolutions. Even plasma coatings of this invention have lower wear rates than plasma coatings of the prior art. Moreover, the coatings can be applied at fast deposition rates without cracking or spalling.

Although the powder and coating compositions have been defined herein with certain specific ranges for each of the essential components, it will be understood that minor amounts of various impurities may also be present. Iron is usually the principal impurity in the coating resulting from grinding operations and may be present in amounts up to about 1.5 and in some cases 2.0 weight percent of the composition.

Although the foregoing examples include only D-Gun and plasma spray coatings, it will be understood that other thermal spray techniques such as "high velocity" plasma, "hypersonic" combustion spray processes or various other detonation devices may be used to produce coatings of the present invention.

We claim:

1. A coating composition applied to a substrate by a thermal spray process which consists essentially of from about 4.0 to about 10.5 weight percent cobalt, from about 5.0 to about 11.5 weight percent chromium, from about 3.0 to about 5.0 weight percent carbon and the balance tungsten.

2. A coated substrate having a coating composition according to claim 1 consisting essentially of from about 5.5 to about 7.5 weight percent cobalt, from about 5.5 to about 7.5 weight percent chromium, from about 3.0 to about 5.0 weight percent carbon and the balance tungsten.

3. A coated substrate having a coating composition according to claim 1 having a mechanical strength sufficient to withstand an hydraulic pressure in excess of about 13,000 pounds per square inch at a coating thickness of about 0.0060 inch.

4. A coated substrate having a coating composition according to claim 1 having a hardness value in excess of 1000 $DPH_{300}$.

5. A coated substrate having a coating composition according to claim 1 wherein the substrate is a metallic material selected from the group consisting of steel, stainless steel, iron base alloys, nickel, nickel base alloys, cobalt, cobalt base alloys, chromium, chromium base alloys, titanium, titanium base alloys, aluminum, aluminum base alloys, copper, copper base alloys, refractory metals, and refractory-metal base alloys.

6. A coated substrate having a coating composition according to claim 1 wherein the substrate is a non-metallic material selected from the group consisting of carbon, graphite and polymers.

7. A coated substrate having a coating composition according to claim 1 consisting essentially of about 8.0 to about 10.5 weight percent cobalt, about 5.0 to 8.0 weight percent chromium, about 3.0 to 4.0 weight percent carbon and the balance tungsten.

8. A coated substrate having a coating composition according to claim 1 consisting essentially of about 9.7 to about 10.1 weight percent cobalt, about 5.0 to about 5.3 weight percent chromium, about 3.4 to about 3.7 weight percent carbon and the balance tungsten.

9. An article comprising a substrate and a coating applied to said substrate by a thermal spray process, said coating consisting essentially of from about 4.0 to about 10.5 weight percent cobalt, from about 5.0 to about 11.5 weight percent chromium, from about 3.0 to about 5.0 weight percent carbon and the balance tungsten.

10. An article according to claim 9 wherein said coating consists essentially of from about 5.5 to about 7.5 weight percent cobalt, from about 5.5 to about 7.5 weight percent chromium, from about 3.0 to about 5.0 weight percent carbon and the balance tungsten.

11. An article comprising a substrate and a coating applied to said substrate by a D-Gun deposition process, wherein said coating consists essentially of from about 4.0 to about 10.5 weight percent cobalt, from about 5.0 to about 11.5 weight percent chromium, from about 3.0 to about 5.0 weight percent carbon and the balance tungsten, and wherein said coating has a hardness value in excess of about 1000 $DPH_{300}$, an average volume loss of about 1.0 $mm^3$ per 1000 revolutions when subjected to a standard dry sand/rubber wheel abrasion test and a mechanical strength sufficient to withstand an hydraulic pressure in excess of about 13,000 pounds per square inch at a coating thickness of about 0.006 inch.

12. An article according to claim 11 wherein the major phase of said coating comprises $W_2C$ and a minor phase comprises cubic WC.

13. An article comprising a substrate and a coating applied to said substrate by a plasma spray process, wherein said coating consists essentially of from about 4.0 to about 10.5 weight percent cobalt, from about 5.0 to about 11.5 weight percent chromium, from about 3.0 to about 5.0 weight percent carbon and the balance tungsten, and wherein said coating has a hardness value in excess of about 775 $DPH_{300}$, an average volume loss of about 6.7 $mm^3$ per 1000 revolutions when subjected to a standard dry sand/rubber wheel abrasion test and a mechanical strength sufficient to withstand an hydraulic pressure in excess of about 9,300 pounds per square inch at a coating thickness of about 0.006 inch.

14. An article according to claim 13 wherein the major phase of said coating comprises $W_2C$ and a minor phase comprises cubic WC.

15. A powdered coating composition for applying a high strength, wear and corrosion resistant coating onto a substrate by a thermal spray process consisting essentially of from about 8.0 to about 11.0 weight percent cobalt, from about 8.0 to about 11.0 weight percent chromium, from about 4.0 to about 5.5 weight percent carbon and the balance tungsten.

16. A powdered coating composition according to claim 15 consisting of cast and crushed powder.

17. A powdered coating composition for applying a high strength, wear and corrosion resistant coating onto a substrate by a thermal spray process consisting essentially of from about 8.0 to about 12.0 weight percent cobalt, from about 6.0 to about 11.0 weight percent chromium, from about 2.5 to about 5.5 weight percent carbon and the balance tungsten.

18. A powdered coating composition according to claim 17 consisting of cast and crushed powder.

19. In a method for coating a substrate wherein a powdered coating material is suspended within a high temperature, high velocity gaseous stream and heated to a temperature at least close to the melting point thereof, said gaseous stream being directed against a surface of said substrate to deposit said powdered coating material and form a coating thereon, the improvement for increasing the strength and wear resistance of said coating, said improvement comprising a powdered coating material having a composition such that the coating deposited onto said substrate consists essentially of from about 4.0 to about 10.5 weight percent cobalt, from about 5.0 to about 11.5 weight percent chromium, from about 3.0 to about 5.0 weight percent carbon and the balance tungsten.

20. A method according to claim 19 wherein the powdered coating material has a composition such that the coating deposited onto said substrate consists essentially of from about 5.5 to about 7.5 weight percent cobalt, from about 5.5 to about 7.5 weight percent chromium, from about 3.0 to about 5.0 weight percent carbon and the balance tungsten.

21. A method according to claim 19 wherein the powdered coating material to be used has a composition consisting essentially of from about 8.0 to about 11.0 weight percent cobalt, from about 8.0 to about 11.0 weight percent chromium, from about 4.0 to about 5.5 weight percent carbon and the balance tungsten.

22. A method for coating a substrate wherein a powdered coating material is suspended within a high temperature, high velocity gaseous stream and heated to a temperature at least close to the melting point thereof, said gaseous stream being directed against a surface of said substrate to deposit said powdered coating material and form a coating thereon, the improvement for increasing the strength and wear resistance of said coating, said improvement comprising a powdered coating material having a composition such that the coating deposited onto said substrate consists essentially of from about 8.0 to about 10.5 weight percent cobalt, from about 5.0 to about 8.0 weight percent chromium, from about 3.0 to about 4.0 weight percent carbon and the balance tungsten.

23. A method according to claim 22 wherein the powdered coating material is suspended within a high temperature, high velocity gaseous stream produced by plasma arc torch.

24. A method according to claim 22 wherein the powdered coating material has a composition which is substantially the same as the composition of said coating.

25. A method according to claim 22 wherein the powdered coating material is suspended within a high temperature, high velocity gaseous stream produced by a detonation device.

26. A method according to claim 22 wherein the powdered coating material has a composition such that the coating deposited onto said substrate consists essentially of from about 9.7 to about 10.1 weight percent cobalt, from about 5.0 to about 5.3 weight percent chromium, from about 3.4 to about 3.7 weight percent carbon and the balance tungsten.

27. A method according to claim 26 wherein the powdered coating to be used has a composition consisting essentially of from about 10.0 to about 12.0 weight percent cobalt, about 6.0 to 6.5 weight percent chromium, about 2.5 to 3.5 weight percent carbon and the balance tungsten.

28. A method for coating a substrate comprising: feeding a mixture of oxygen and a fuel gas to the barrel of a detonation gun along with a powdered coating material; igniting the oxygen and fuel gas mixture to produce a detonation wave along said barrel which accelerates said powdered coating material in a high temperature, high velocity gaseous stream; and directing said gaseous stream against a surface of said substrate to deposit said powdered coating material and form a coating thereon, said powdered coating material having a composition such that the coating deposited onto said substrate consists essentially of from about 4.0 to about 10.5 weight percent cobalt, from about 5.0 to about 11.5 weight percent chromium, from about 3.0 to about 5.0 weight percent carbon and the balance tungsten.

29. A method according to claim 28 wherein the powdered coating material has a composition such that the coating deposited onto said substrate consists essentially of from about 5.5 to about 7.5 weight percent cobalt, from about 5.5 to about 7.5 weight percent chromium, from about 3.0 to about 5.0 weight percent carbon and the balance tungsten.

30. A method according to claim 28 wherein the ratio of oxygen to fuel gas in said mixture is approximately 1.0.

31. A method according to claim 30 wherein the powdered coating material has a composition consisting essentially of from about 8.0 to about 11.0 weight percent cobalt, from about 8.0 to about 11.0 weight percent chromium, from about 4.0 to about 5.5 weight percent carbon and the balance tungsten.

32. A method for coating a substrate comprising: feeding a mixture of oxygen and a fuel gas to the barrel of a detonation gun along with a powdered coating material; igniting the oxygen and fuel gas mixture to produce a detonation wave along said barrel which accelerates said powdered coating material in a high temperature, high velocity gaseous stream; and directing said gaseous stream against a surface of said substrate to deposit said powdered coating material and form a coating thereon, said powdered coating material having a composition such that the coating deposited onto said substrate consists essentially of from about 8.0 to about 10.5 weight percent cobalt, from about 5.0 to about 8.0 weight percent chromium, from about 3.0 to about 4.0 weight percent carbon and the balance tungsten.

33. A method according to claim 32 wherein the ratio of oxygen to fuel gas in said mixture is approximately 1.0.

34. A method according to claim 32 wherein the powdered coating material has a composition such that the coating deposited onto said substrate consists essentially of from about 9.7 to about 10.1 weight percent cobalt, from about 5.0 to about 5.3 weight percent chromium, from about 3.4 to about 3.7 weight percent carbon and the balance tungsten.

35. A method according to claim 34 wherein the powdered coating material has a composition consisting essentially of from about 10.0 to about 12.0 weight percent cobalt, from about 6.0 to about 6.5 weight percent chromium, from about 2.5 to about 3.5 weight percent carbon and the balance tungsten.

* * * * *